United States Patent [19]

Takahashi et al.

[11] Patent Number: 4,475,963

[45] Date of Patent: Oct. 9, 1984

[54] METHOD FOR POSTWELD HEAT TREATMENT

[75] Inventors: Eiji Takahashi, Akashi; Kenji Iwai, Kobe, both of Japan

[73] Assignee: Kabushiki Kaisha Kobe Seiko Sho, Kobe, Japan

[21] Appl. No.: 231,913

[22] Filed: Feb. 5, 1981

[51] Int. Cl.[3] ..... C21D 11/00

[52] U.S. Cl. ..... 148/128

[58] Field of Search ..... 148/128, 134, 127

[56] References Cited

PUBLICATIONS

*Welding Journal,* vol. 58, No. 52, Feb. 1979, Miami, US, W. S. Kyte: "Postweld Heat Treatment for Hydrogen Removal", pp. 54s–58s, Whole document.

*Metals Technology,* vol. 2, Feb. 1975, London, GB, B. Chew: "Diffusion of Hydrogen in Fillet Welds", pp. 66–72, p. 70.

*Stahl und Eisen,* vol. 98, No. 22, Nov. 2, 1978, Dusseldorf, DE V. Pilous: "Temperaturfuhrung beim Schweissen eines warmfesten Cr—Mo—Ni—V—Stahles mit 0,18%C und 0,92% Cr in grossen Wanddicken", pp. 1167–1170.

Metals Technology; Feb. 1975; "Diffusion of Hydrogen in Fillet Welds", B. Chew, W. S. Kyte; pp. 66–72.

Welding Journal; Feb. 1979; "Postweld Heat Treatment for Hydrogen Removal", W. S. Kyte, B. Chew; pp. 54–58.

Stahl und Eisen, vol. 100, No. 1, Jan. 1, 1980, Dusseldorf, DE V. Pilous: "Beitrag zum Schweissen eines warmfesten Cr—Mo—Ni—V—Stahles mit 0,18%C und 1% Cr fur Schmiedestucke im Kraftwerksbau", pp. 9–12.

Ohmae et al., Study on the Rationalization of Intermediate Postweld Heat Treatment, Mar. 1975, Mitsubishi Jukogyo Technical Bulletin, vol. 12, No. 2, pp. 46–51.

Eiji Takahashi et al., Prevention of the Transverse Cracks in Heavy Section Butt Weldments of $2\frac{1}{4}$Cr—1Mo Steel Through Low Temperature Postweld Treatment (Reports 1–3), Apr. 1979, Oct. 1979, Transaction Japan Welding Society, vol. 10, 1979.

*Primary Examiner*—Peter K. Skiff

*Attorney, Agent, or Firm*—Oblon, Fisher, Spivak, McClelland & Maier

[57] ABSTRACT

A method for postweld heat treatment (hereinafter referred to as PWHT) for multilayer welding, in which the terminating point of the PWHT is correctly judged to preclude cracking due to insufficient treatment or uneconomical excessive treatment, the method including the steps of determining the residual hydrogen concentration directly beneath the final welded layer immediately after completion of welding determining a crack-preventing critical hydrogen concentration to obtain a ratio of the critical hydrogen concentration to the residual hydrogen concentration determining the value of a product of a hydrogen diffusivity coefficient during the heat treatment and a holding time where a hydrogen concentration currently occurring in the heat treatment reaches the critical hydrogen concentration, on the basis of the relation of a ratio of the current hydrogen concentration to the residual hydrogen concentration and a sum of a parameter of hydrogen diffusion to be determined depending upon the welding conditions and the above-mentioned product measuring the temperature of the heat treatment at a suitable point of the weld, and terminating the heat treatment at a point in time when a time-integrated value of a hydrogen diffusivity coefficient at the measured temperature exceeds the value of the above-mentioned product.

7 Claims, 29 Drawing Figures

METHOD FOR POSTWELD HEAT TREATMENT

BACKGROUND OF THE INVENTION

1. Field of the Invention

This invention relates to a method for postweld heat treatment (hereinafter referred to as PWHT) of a welded portion of thick base metal, and more particularly to a method for appropriately judging the point in time for terminating the PWHT in dissipating residual diffusible hydrogen in a welded metal by afterheating.

2. Description of the Prior Art

A problem of cold (or delayed) cracking when welding thick low alloy steels has been known to sometimes occur. At present, it is the usual practice to resort to intermediate stress relief annealing for preventing cracking of that sort. However, as seen in desulfurizing reaction towers and coal liquefaction systems, there is a distinctive trend in recent chemical industries practices toward plants on larger scales, which involve for an increased number of instances of intermediate stress relief annealing after welding. The repetitious intermediate stress relief annealing not only gives rise to deteriorations in strength and toughness of the material but also hinders the fabrication process, inviting increases in the time period for and cost of fabrication.

SUMMARY OF THE INVENTION

Under these circumstances, research was conducted concerning multilayer butt welds of thick 2¼Cr—1Mo steel and A508 Class 3 material and it was found that: (1) the problematic cracks are mostly transverse cracks in a weld zone, that is to say, weld metal or heat affected zone (HAZ); (2) the cracks are apt to occur immediately beneath the final layer due to the residual stress in the direction of weld line, diffusible hydrogen and hard microstructure, propagating and growing toward the inner and outer surfaces of a plate; and (3) the residual stress remains almost the same independent of the plate thickness but the residual hydrogen decreases upon raising the preheat and interpass temperature at the time of welding, resulting in preventing the occurrence of a crack. From these facts, it is gathered that the most effective means for preventing cracks is to decrease diffusible hydrogen concentration in the weld zone.

For this reason, research was focussed on the so-called low-temperature PWHT which prevents cracking by decreasing diffusible hydrogen concentration in a weld zone by heating the weld zone at a relative low temperature immediately after welding. Since this method is intended to prevent cracking solely through the diminution of diffusible hydrogen concentration in the weld zone, it is necessary to clarify the following items before its application.

(1) The relation between the conditions of welding operation for an actual structure and the hydrogen concentration immediately after welding.

(2) The relation between the variations in the hydrogen concentration during low-temperature PWHT and the treating conditions.

(3) The relation between the critical hydrogen concentration which precludes the cracking and the maximum Vicker's hardness number in the weld zone.

Items (1) to (3) were clarified by experiments for butt weldments of thick 2¼Cr—1Mo steel and A508 Class 3 material and research on the basis of the experimental data. As a result, cracking was prevented by an appropriate PWHT, permitting omission of the intermediate stress relief annealing.

More particularly, the gist of the present invention resides in:

(1) A step of obtaining the residual hydrogen concentration $[Co]_D$ and $[Co]_H$ directly beneath the finally welded layer immediately after completion of multilayer welding, where $[Co]_D$ and $[Co]_H$ are for weld metal and for heat affected zone, respectively.

(2) A step of obtaining the critical hydrogen concentration for the prevention of cracking, that is to say, $[Ccr]_D$ and $[Ccr]_H$ for weld metal and HAZ, respectively, which depend upon the maximum residual stress and maximum Vicker's hardness number of microstructure in weld zone.

(3) A step of obtaining the values of $[Ccr/Co]_D$ and $[Ccr/Co]_H$, ratio of the critical hydrogen concentration $[Ccr]_D$ and $[Ccr]_H$ for the prevention of cracking both in the weld metal and HAZ to the residual hydrogen concentration $[Co]_D$ for weld metal and $[Co]_H$ for HAZ.

(4) A step of obtaining the values of $[C/Co]_D$ and $[C/Co]_H$ for weld metal and HAZ, respectively, the ratios of the hydrogen concentration in the weld zone $[C]_D$ and $[C]_H$ which are lessened by the low-temperature PWHT to the residual hydrogen concentration $[Co]_D$ and $[Co]_H$.

(5) A step of, from the relation of the sum $[\tau+D_p \cdot t_p]_D$ for weld metal and $[\tau+D_p \cdot t_p]_H$ for HAZ of a hydrogen diffusion parameter $[\tau(cm^2)]$ in a welding operation under given conditions $$\tau = \int_0^{tn} D_i dt$$

wherein $D_i$: a hydrogen diffusivity coefficient ($cm^2$/sec) in an arbitrary weld zone of each unit layer;

tn: the time required for welding each unit layer and the product of a hydrogen diffusivity coefficient $[D_p(cm^2/sec)]$ during the PWHT and the holding time $[t_p(sec)]$ and $[C/Co]_D$ and $[C/Co]_H$, predetermining the values of $[D_p \cdot t_p]_D$ and $[D_p \cdot t_p]_H$ for weld metal and HAZ, respectively, where [C] is equal to $[Ccr]_D$ or $[Ccr]_H$.

(6) A step of determining a larger value of $[D_p \cdot t_p]_D$ or $[D_p \cdot t_p]_H$ by comparing those values, namely, $[D_p \cdot t_p]$ as a condition of PWHT.

(7) A step of measuring the temperature at a suitable portion of the weld during PWHT to terminate the heat treatment at a time point when the time-integrated value of the hydrogen diffusivity coefficient $[D_{pi}(cm^2/sec)]$ at the measured temperature exceeds the value of $[D_p \cdot t_p]$.

It should also be noted that, when the maximum Vicker's hardness number of microstructure in weld metal is higher than that in HAZ, the estimation of above-mentioned respective values only for weld metal is sufficient because the hydrogen concentration in HAZ is generally much lower than that in weld metal.

In the method of the present invention, for instance, the first step of obtaining the value of [Co] can be realized by various means or procedures in practical applications. The gist of the invention resides in the above-mentioned steps (1) to (7) and is not limited to practical procedures employed therefor. The particular procedures developed in the following description are given only as typical examples and should not be construed as limiting the present invention. In this regard, it is to be noted that the invention includes all modifications and alterations as encompassed by the appended claims.

DETAILED DESCRIPTION OF THE PREFERRED EMBODIMENT

The method of the invention is hereafter described by way of fundamental tests conducted on 2¼Cr—1Mo steel and A508 Class 3 material, results of the experiments and practical procedures for the respective steps.

[Testing Method]

1. Test specimens and welding conditions

The base metal used in the tests was 200 mm thick rolled material of ASTM A387 GR22 Class 2 and a forged A508 Class 3 material. Those chemical compositions and mechanical properties are shown in Table 1.

TABLE 1

| | Chemical Composition | | | | | | | | | Mechanical Properties | | |
|---|---|---|---|---|---|---|---|---|---|---|---|---|
| | C | Si | Mn | P | S | Ni | Cr | Al | Mo | El.(%) | Y.P. (kg/cm²) | T.S. (kg/cm²) |
| A387 GR22 C1.2 | 0.13 | 0.30 | 0.47 | 0.01 | 0.01 | — | 2.39 | — | 1.00 | 23.6 | 34.8 | 58.9 |
| A508 C1.3 | 0.17 | 0.29 | 1.40 | 0.006 | 0.007 | 0.79 | — | 0.021 | 0.47 | 27.0 | 56.8 | 69.5 |

Table 2 below shows the submerged arc welding conditions.

TABLE 2

| Material | A387 GR22 C1.2 | A508 C1.3 |
|---|---|---|
| Welding wire | US-521A (4.8Ø) | US-56B (4.0Ø) |
| Flux | MF-29A, MF-29AX | MF-27 |
| Welding current | 650 A | 650 A |
| Welding voltage | 36 V | 33 V |
| Welding speed | 35 cm/min | 35 cm/min |
| Heat input | 40 KJ/cm | 37 KJ/cm |

The flux MF-29A or MF-27 was mainly used in the tests but the recently developed flux MF-29AX of low hydrogen level was used in certain cases.

Table 3 shows the chemical composition and mechanical properties of the weld metals.

TABLE 3

| Flux × Wire | C | Si | Mn | P | S | Cr | Ni | Mo | El.(%) | Y.P. (kg/cm²) | T.S. (kg/cm²) |
|---|---|---|---|---|---|---|---|---|---|---|---|
| | Chemical Composition (%) | | | | | | | | Mechanical Properties | | |
| MF-29A × US-521A | 0.09 | 0.24 | 0.73 | 0.015 | 0.009 | 2.37 | — | 1.03 | 18 | 86 | 95 |
| MF-29AX × US-521A | 0.087 | 0.24 | 0.76 | 0.011 | 0.008 | 2.39 | — | 1.03 | — | — | — |
| MF-27 × US-56B | 0.08 | 0.31 | 1.17 | 0.01 | 0.006 | — | 0.87 | 0.49 | 28.4 | 65 | 73 |

Figure 1A:
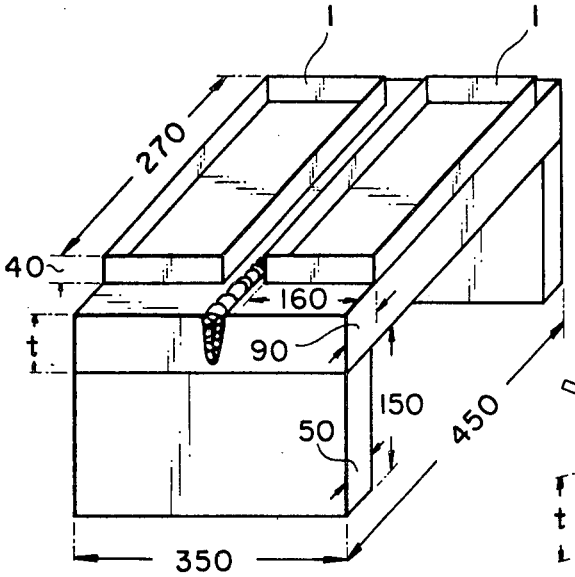
FIG. 1(A) is a perspective view showing the conditions of test welding and FIG. 1(B) illustrates a sampling position of a test piece.
Figure 1B:
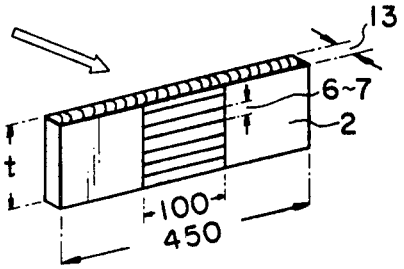

2. Measurement of hydrogen concentration distribution in thick plate welds immediately after welding Upon completion of welding, the distribution of hydrogen concentration in the direction of plate thickness immediately after the final bead cooled to an interpass temperature was measured, varying the preheating/interpass temperature and the plate thickness to clarify experimentally their influences on the distribution of hydrogen concentration in the weld metals. The obtained hydrogen distributions were used as comparative data against the calculated values to confirm the reliability of the program of the finite element method for estimating the hydrogen distribution immediately after welding as described in the next paragraph. The shape and dimensions of the welding joint used for the measurement of diffusible hydrogen concentration are shown in FIG. 1(A), while the sampling position of the test piece for its purpose is shown in FIG. 1(B) in which the various lengths are in the unit of mm and indicated by reference number 1 are trays for holding a cooling medium and dry ice and by reference number 2 is a cut of the weld metal test piece.

3. Analysis of hydrogen diffusion during welding by finite element method

For handling the hydrogen diffusion during the welding operation, it is preconditional to reproduce the welding thermal cycle. However, the present invention is based on research directed to plates of a thickness of 50 mm or greater which require welding in a relatively large number of layers and the submerged arc welding process is generally utilized with high heat input, so that it is almost impossible to simulate on the test piece the welding thermal cycle which takes place when welding an actual structure. Therefore, an analysis based on the finite element method was utilized.

Figure 2:
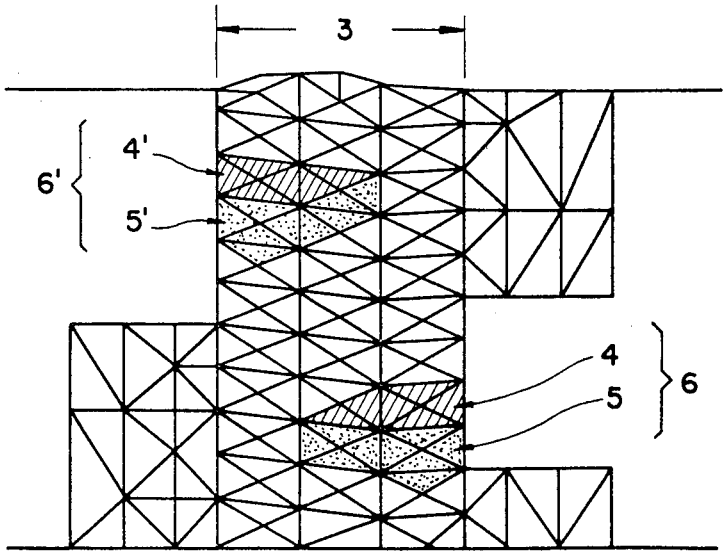
FIG. 2 is a diagrammatic view explanatory of the way to divide a welded joint into small elements for the analysis by the finite element method.

FIG. 2 illustrates an element division of a weld zone into small triangless of I-beveling welded with 2 passes per layer and having a penetration rate of 60%. In this figure, reference numeral 6 denotes the weld of the first pass consisting of a weld portion 4 and a penetrated portion 5. Indicated by reference number 6' is the weld of the 12th pass consisting of a weld portion 4' and a penetrated portion 5'. In this instance, the sum of residual hydrogen in the penetrated portion and a predetermined amount of hydrogen dissolved in the respective weld portion at the time of each weld is divided by the total weight of the weld and penetrated portions, allotting the mean value uniformly thereto as initial hydrogen concentration existing when welding each weld pass. The hydrogen concentration at the nodes on the surfaces were considered as being constantly held at zero throughout the analysis.

On the other hand, calculation for the welding thermal history which is preconditional to the analysis of the hydrogen diffusion was performed with a heat input of 40 KJ/cm for 2¼Cr—1Mo steel welds and 37 KJ/cm for A508 Class 3 welds and a heat efficiency of 65%, equivalently redistributing them to the weld and penetrated portions.

Figure 3:
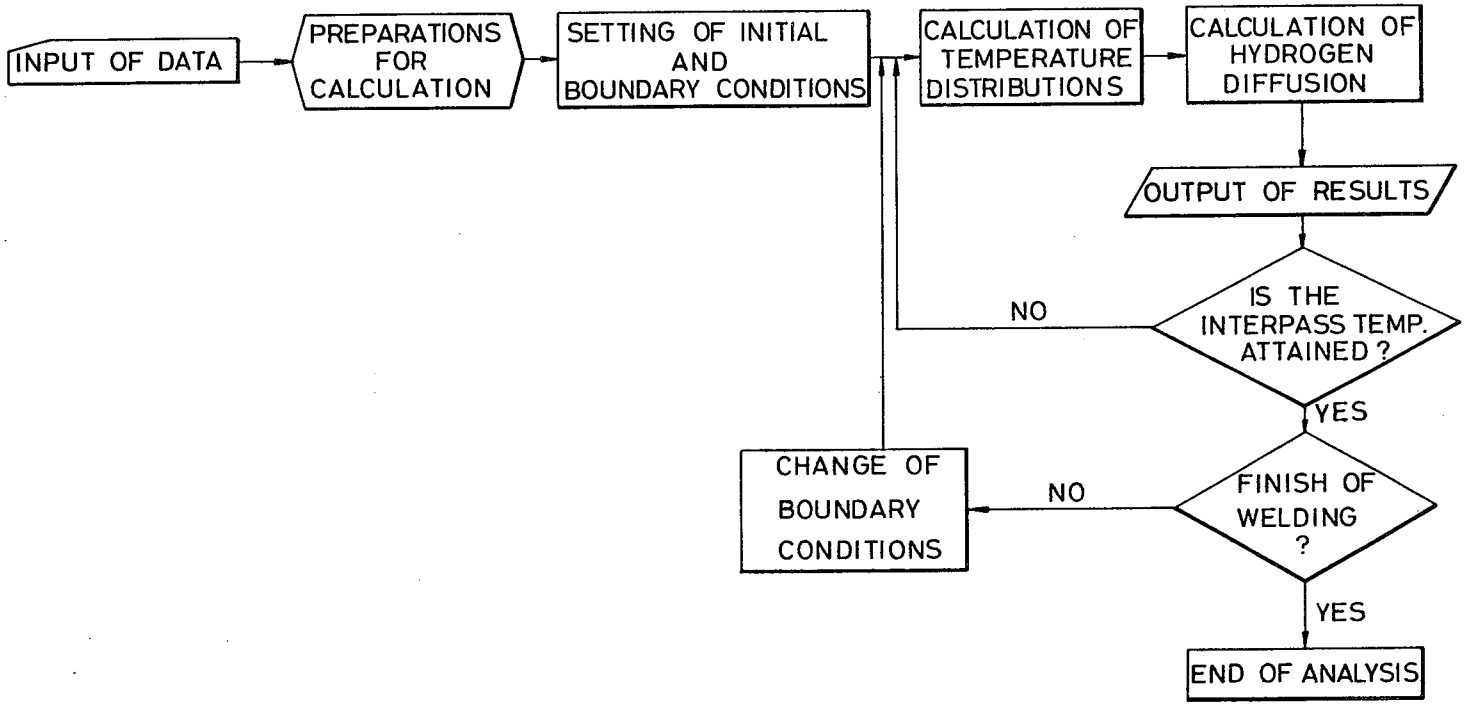
FIG. 3 is a flow chart showing a program for the analysis by the finite element method.

FIG. 3 is a flow chart of a program used for the analysis. The time increment for each analysis was set in the range of 1 to 10 seconds to correspond with the cooling rate. The shift to the next pass was affected when a predetermined temperature was reached at a position located 10 mm inside the beveling face and 15 mm deep from the plate surface, compiling that temperature as an interpass temperature. With a larger plate thickness, the temperature was controlled by varying the measuring positions a few times along the plate thickness in accordance with the progress of the welding operation. In the various tests using a test specimen as shown in FIG. 1, the welding thermal cycle was controlled by a CA thermocouple which was inserted at such measuring positions for conformity with conditions of calculation.

Figure 4:
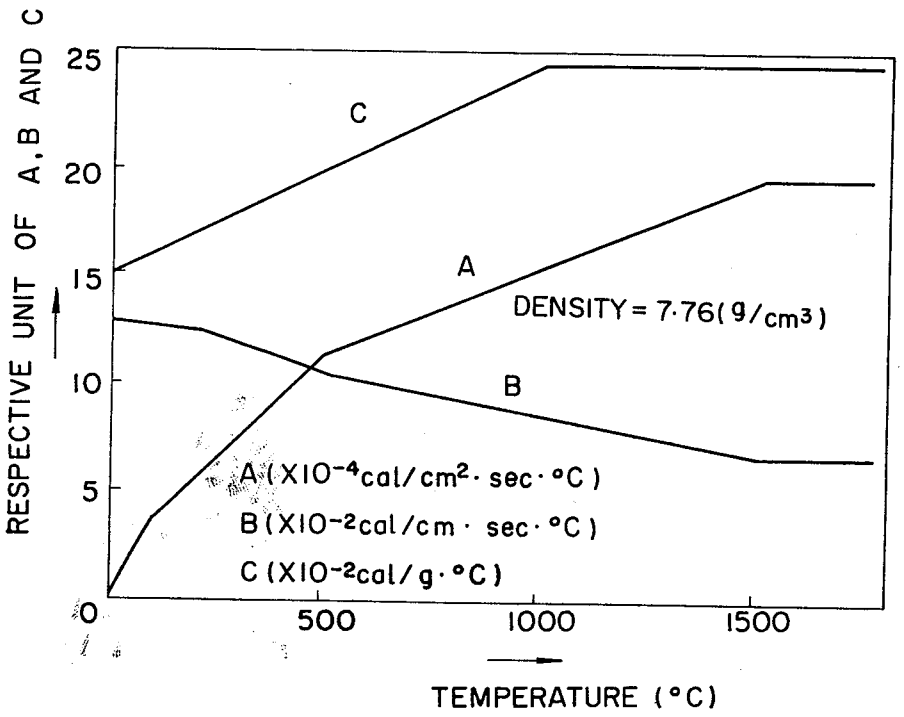
FIG. 4 is a diagram showing the dependency on temperature of various thermal constants.
Figure 5:
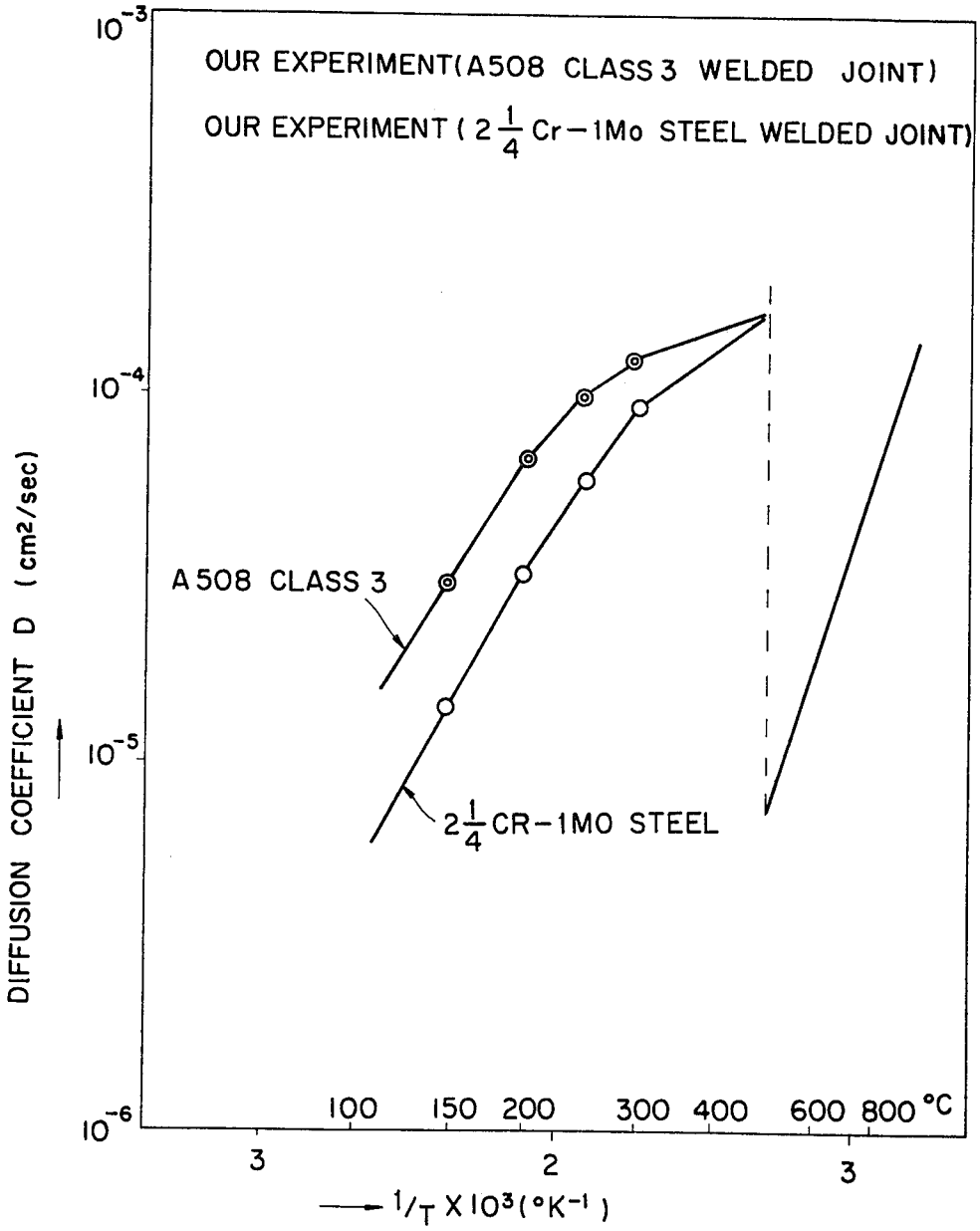
FIG. 5 is a diagram showing the relation between the hydrogen diffusivity coefficient and the temperature.

FIGS. 4 and 5 show the dependency on temperature of the various thermal constants and the hydrogen diffusivity coefficient which were used in the calculations. With regard to the thermal transfer coefficient A, thermal conductivity B and specific heat C, the density was held constant in consideration of their dependency on temperature shown. For the dependency on temperature of the hydrogen diffusivity coefficient, the value indicated by solid lines in FIG. 5 was used.

4. Determination of hydrogen diffusivity coefficient of welded joints

The hydrogen diffusivity coefficient was determined by actually measuring the distributions of hydrogen concentration immediately after welding and after the low-temperature PWHT and comparing the measured values with calculated values as obtained under the same conditions.

Figure 6:
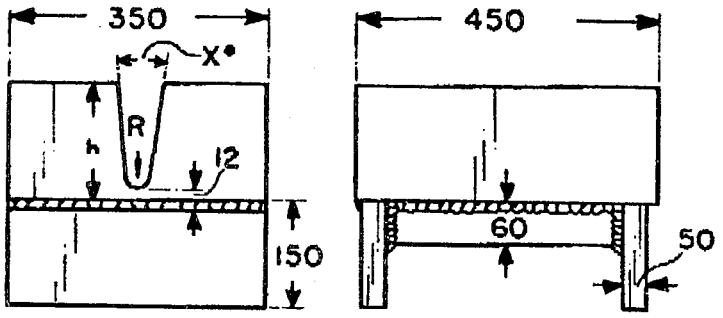
FIG. 6 is a schematic view explanatory of the restraint test specimen used in the cracking tests.

5. Cracking test for determining critical hydrogen concentration free from transverse cracks In order to know to what extent the concentration of residual hydrogen in the weld zone immediately after welding has to be reduced for the prevention of cracking, namely, in order to know the crack-free critical hydrogen concentration, cracking tests were conducted with the use of restrained test specimens as shown in FIG. 6, in which the respective dimensions are indicated in the unit of mm. The dimensions of h (plate thickness) X° (angle of beveling) and R (radius of curvature at the root of beveling) were varied in the cracking tests under the conditions shown in Table 4.

TABLE 4

| Material | h | X° | R | Interpass temperature (°C.) | Temperature of PWHT (°C.) | Holding time of PWHT (hr.) |
|---|---|---|---|---|---|---|
| A387 | 55 | 8 | 8 | 180 | 180~200 | 1.5, 2.6, 3.2 |
| GR22 | 100 | 7 | 8 | 130 | 180~205 | 2.5, 7.0 |
| C1.2 | 150 | 5.5 | 8 | 150 | 205 | 7.5 |
| A508 | 525 | 8 | 8 | 175 | — | — |
| C1.3 | | | | 200 | — | — |
| | | | | 250 | — | — |
| | | | | 200 | 200 | 2.25 |

The low-temperature PWHT was performed in an annealing furnace. Leaving the test specimen at room temperature for two weeks after the low-temperature PWHT, vertical sections of the weld were cut out to check the existence of cracks by magnaflux detection and by the naked eye after etching.

Next, the hydrogen diffusion during PWHT was analyzed by the use of the thermal history which was obtained in the cracking test during the time interval from the completion of welding to the time point when the temperature of the test specimen cooled down to 100° C. after the low temperature PWHT, thereby determining the hydrogen distribution in the weld zone at the temperature of 100° C. Thereafter, the crack-preventing critical hydrogen concentration was determined on the basis of the results of the cracking test and the corresponding distribution of hydrogen concentration.

Figure 7:
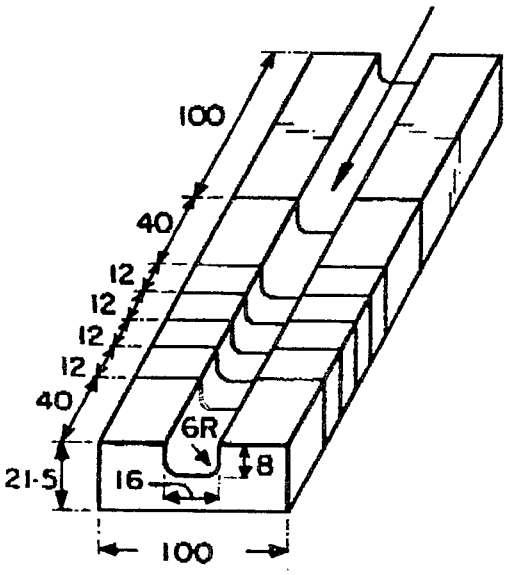
FIGS. 7(A) and 7(B) are schematic perspective views showing the method for measuring diffusible hydrogen which is dissolved into weld metal by one welding pass.
Figure 7:
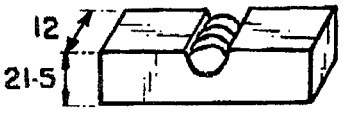

6. Measurement of initial hydrogen content necessary for determining conditions of low temperature PWHT in accordance with the combination of base metal and welding materials A test piece as shown in FIG. 7(A) (in which all the dimensions are indicated in the unit of mm) was welded with one pass in the arrowed direction which was, immediately after being quenched in a water bath with crushed ice, put in liquid nitrogen to fix hydrogen. Thereafter, four test pieces were cut off as shown in FIG. 7(B) for the determination of hydrogen. These test pieces were sealed in a vacuum container for about 20 days at room temperature and then subjected to determination of diffusible hydrogen by a vacuum extraction apparatus.

[Test results and practical procedures]

Figure 8:
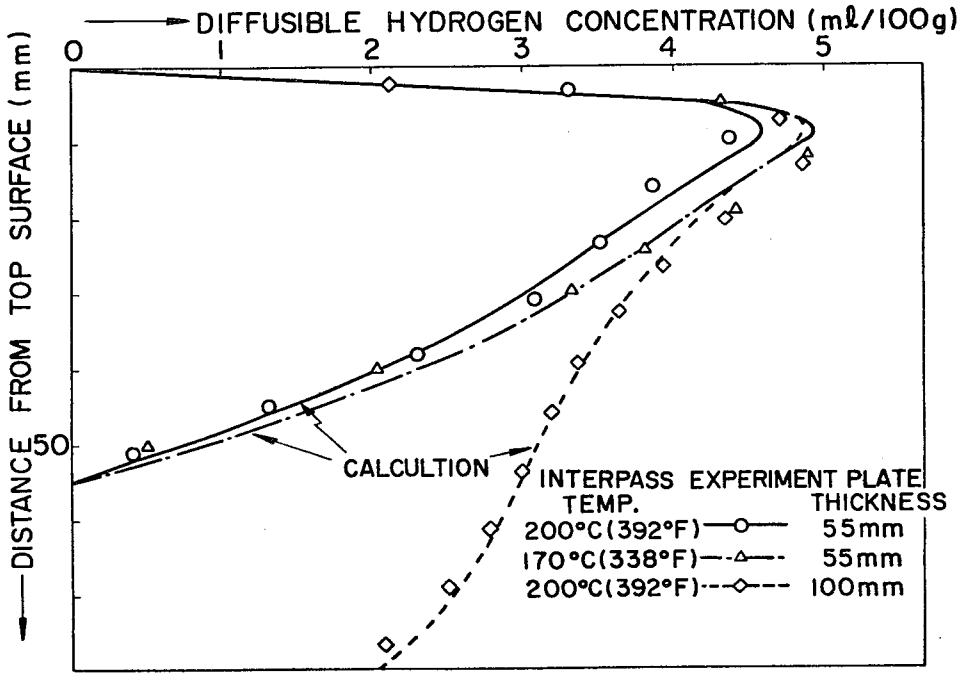
FIG. 8 is a diagram comparatively showing the actually measured and calculated values of the hydrogen concentration distribution at a point in time when the final bead reaches an interpass temperature.

1. Relation between hydrogen concentration immediately after welding and conditions of welding operation FIG. 8 shows actually measured and calculated values of the hydrogen distribution in the weld metal of $2\frac{1}{4}$Cr—1Mo steel weldments when the final pass of the weld is cooled down to the interpass temperature. In this figure, the marks "O", "Δ" and "□" represent the actually measured values and the curves indicate the results of analysis. Both the actually measured and calculated values have peaks in the vicinity of a point immediately beneath the final layer, showing a higher value with a greater plate thickness. Generally, the calculated values coincide with the actually measured values indicative of the reliability of the analyzing computer program. As mentioned hereinbefore, it is necessary to employ a large test specimen in order to simulate the cooling rate in actual welding involving a thick and wide plate. However, the hydrogen distribution in such a case can easily be obtained by the use of the analysing program.

Next, it is important to determine the relation between the hydrogen concentration immediately beneath the final bead and the conditions of welding operation for the prevention of transverse cracking induced in weld metal. With regard to the hydrogen concentration immediately beneath the newest bead after its pass of welding, it is determined by dissolved hydrogen from the arc column and residual hydrogen in the vicinity of the penetrated portion of the bead. It is easily conceivable that the latter is determined by dissolved hydrogen from the arc column during each pass of welding and residual hydrogen in the vicinity of the penetrated portion and the welding thermal history until that pass. In this instance, it is known that the dissolved hydrogen from the arc column in each pass welding is constant and according to the results of the study in the regard, the thermal history in each pass or welding is considered to be substantially the same. Therefore, the hydrogen concentration immediately beneath the penetrated portion after welding the final bead in multilayer welding can be determined from the mean hydrogen concentration in the weld immediately after welding the initial layer and one welding thermal history in the proximity of the final layer.

As to the hydrogen concentration of HAZ, the same consideration can be accepted because it becomes a function of hydrogen concentration in weld metal.

It is known from Fick's Second Law that a variation in hydrogen concentration during a small time period $\Delta ti$ at a certain point is proportional to $Di \cdot \Delta ti$ where Di is the diffusivity coefficient at that point. It follows that the quantity of hydrogen which is diffusingly released from the weld zone in one welding thermal cycle is considered to be determined by ${}_i^{\Sigma}Di \cdot \Delta ti$ which is obtained by dividing the thermal cycle into the small time periods $\Delta ti$ and adding $Di \cdot \Delta ti$ corresponding to the respective $\Delta ti$.

Figure 9A:
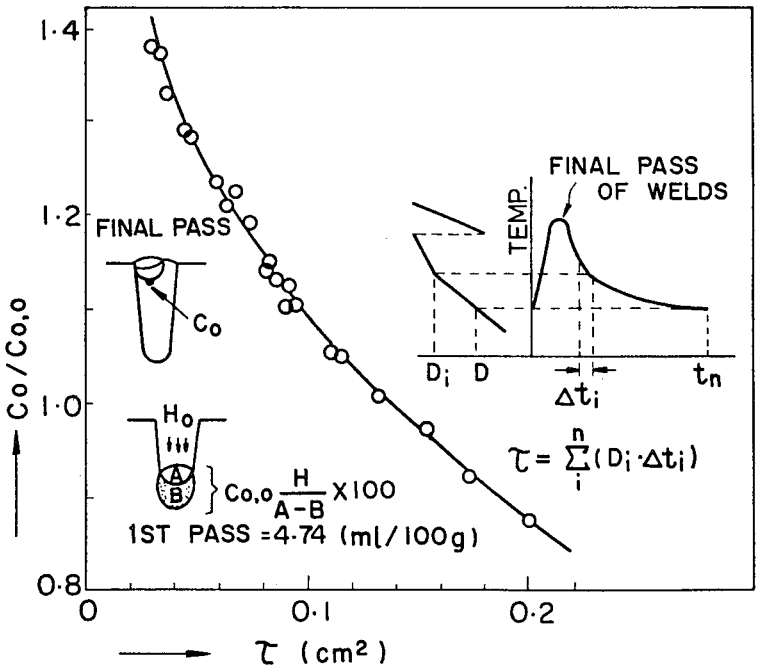
FIGS. 9(A) and (B) are the diagrams showing the relations between the hydrogen concentration immediately beneath the final pass of welds right after welding and the parameter ($\tau$) of hydrogen diffusion at the time of welding for weld metal of 2¼Cr—1Mo steel weldments and for HAZ of A508 Class 3 weldments, respectively.

In view of the fact that transverse cracking is most likely to occur in weld metal of $2\frac{1}{4}$Cr—1Mo steel weldment or in HAZ of A508 Class 3 weldments immediately beneath the final layer, the value of ${}_i^{\Sigma}Di \cdot \Delta ti$ was determined on the basis of the thermal history of the final pass of welds, determining its relation with the hydrogen concentration in weld metal or in HAZ immediately beneath the penetrated portion of the final pass of welds. In FIG. 9(A) for 2θCr—1Mo steel weldments, the abscissa represents $\tau$ for ${}_i^{\Sigma}Di \cdot \Delta ti$ while the ordinate represents the hydrogen concentration in weld metal directly beneath the final bead immediately after welding the final pass, non-dimensionally in terms of the mean hydrogen concentration in the weld metal immediately after the initial welding. Here, the discussion is based on welding of one layer with one pass. In a case where one layer is welded with n-number of passes, this relation can be generalized by graduating the abscissa on the scale of (1/n) (the same applies hereafter). The results of calculation shown in FIG. 9(A) were obtained by varying the conditions of the welding operation over a wide range, including the thickness and width of plates and preheating and interpass temperatures. As is clear from the figure, the relation between the hydrogen concentration in weld metal directly beneath the final pass immediately after welding and the parameter $\tau$ of hydrogen diffusion determined from the welding thermal history depending upon welding conditions can be expressed by a single curve. The same relation was obtained for HAZ of A508, Class 3 weldments as shown in FIG. 9(B).

Figure 9B:
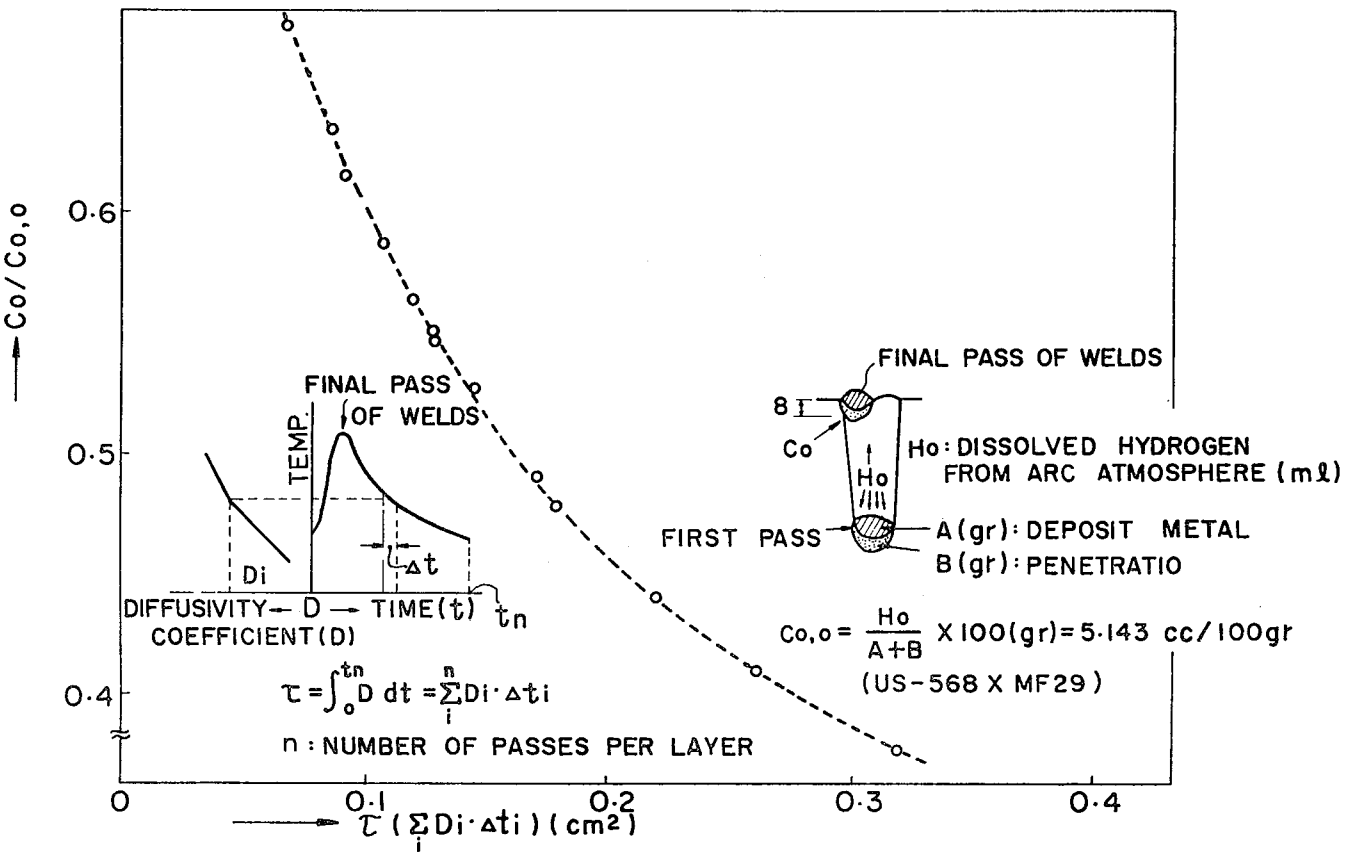

By the use of the diagram of FIG. 9(A) or 9(B), it becomes possible to dispense with the calculations which would otherwise be necessitated by variations in the mean hydrogen concentration Co,o in the weld immediately after welding the first layer, as a result of use of a flux of a different hydrogen level or a variation in the coefficient of hydrogen diffusion due to use of a different material. The hydrogen concentration directly beneath the final pass can be readily obtained as long as the value of Co,o or one welding thermal cycle in the vicinity of the final layer and the coefficient of hydrogen diffusion are known.

The relation between the parameter $\tau$ of hydrogen diffusion and the conditions of welding operations is now considered.

Figure 10:
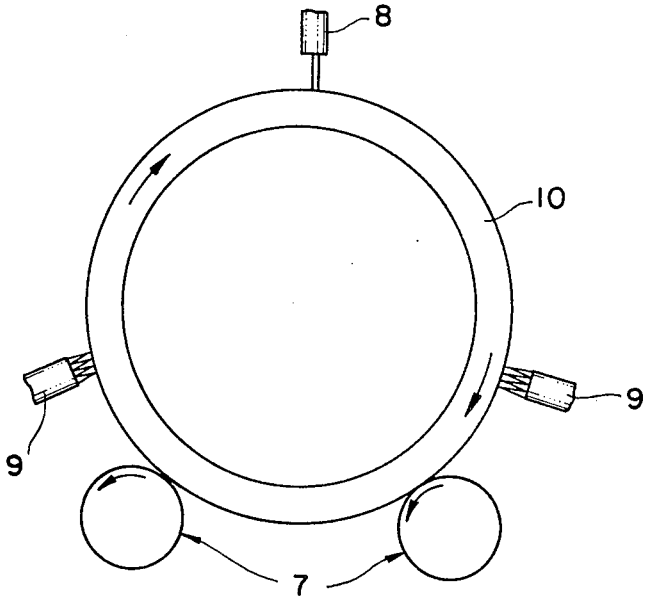
FIG. 10 is a schematic view of gas burners employed for auxiliary heating for maintaining an interpass temperature at the time of welding.

The foregoing description has dealt with the results where the next pass of welding is proceeded at a time point when the bead temperature reaches the level of the interpass temperature. However, in actual operation, there sometimes occurs a temperature drop during the pass interval which is elongated depending upon the size of a pressure vessel or the like. In such a case, the interpass temperature is maintained by an auxiliary heating mechanism like gas burners as shown in FIG. 10. In this figure, indicated by reference number 7 is a turning roller, by 8 a welding torch, by 9 a gas burner and by 10 a shell course of a pressure vessel. While the welding bead temperature which has reached the interpass temperature is maintained at that level by the auxiliary heating mechanism until the subsequent weld bead is deposited, it is now necessary to consider the influence of the auxiliary heating on the parameter $\tau$ of hydrogen diffusion.

With the auxiliary heating, the value of the parameter $\tau$ which is determined by one welding thermal cycle consists of the value of $\tau$ shown in FIGS. 9(A), (B) plus the contribution of the auxiliary heating, that is to say, the product $D \cdot \Delta ta$ of the time interval $\Delta ta$ at which the welding of a next bead is deposited after the bead temperature reaching the interpass temperature and the coefficient D of hydrogen diffusion at the temperature. The value of $\Delta ta$ varies depending upon the welding conditions such as the interpass temperature, welding speed, dimensions of the base metal, for example, the diameter of a vessel when a girth welding to join the shell courses of a pressure vessel is performed.

Figure 11:
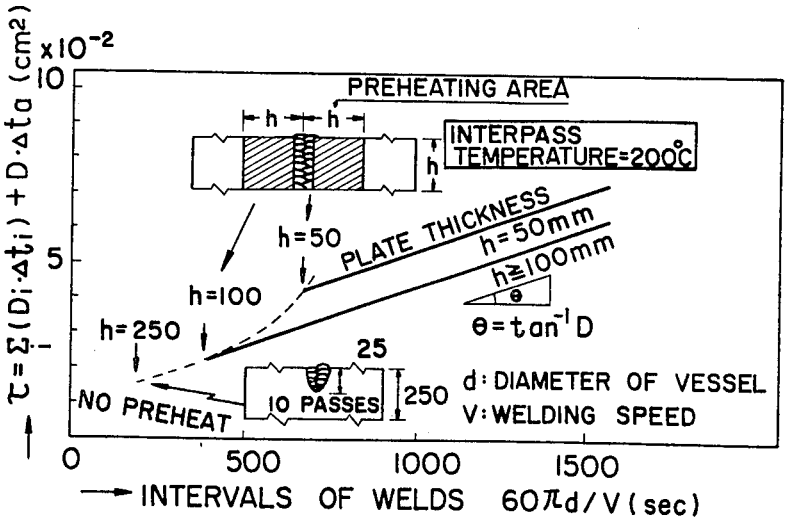
FIGS. 11 and 12 are diagrams showing the relation between welding conditions and the parameter ($\tau$) of hydrogen diffusion with auxiliary heating for 2¼Cr—1Mo steel weldments.

FIG. 11 shows the relation between the pass interval and the parameter $\tau$ in a case where a joint of infinitely wide plate of 2¼Cr—1Mo steel is welded at an interpass temperature of 200° C. and, when the bead temperature reaches the interpass temperature at the time of welding each pass, it is maintained constantly at the interpass temperature by the auxiliary heating until the commencement of welding of the next pass. In this figure, the broken line indicates the relation between the time in which the bead temperature cools off to the interpass temperature after the welding of the bead and the value of $\tau$ as determined by the welding thermal cycle at that time, namely, the value of $_i\Sigma Di \cdot \Delta ti$ of FIG. 9(A). In this instance, the preheating zones on opposite sides of the weld were locally preheated to 200° C. over a width corresponding to the plate thickness of 50 mm or 100 mm. The value of $\tau$ thus obtained was 0.041 cm$^2$ with a plate thickness of 50 mm and 0.022 cm$^2$ with a plate thickness of 100 mm. The value of $\tau$ resulting from overall preheating was 0.041 cm$^2$ with a plate thickness of 50 mm and 0.023 cm$^2$ with a plate thickness of 100 mm, which were substantially the same as the values in the case of local preheating. It is known therefrom that, in the multilayer welding for plates of extremely great thickness, the preheating in the initial stage imposes almost no influence on the welding thermal cycle of the final layer due to dissipation of heat over a long time period before completion of the welding. Therefore, the relation between the cooling time to the interpass temperature after the final pass of welding and $_i\Sigma Di \cdot \Delta ti$ for a plate thickness of 250 mm was determined on the welding of the final ten passes alone without preheating.

Figure 12:
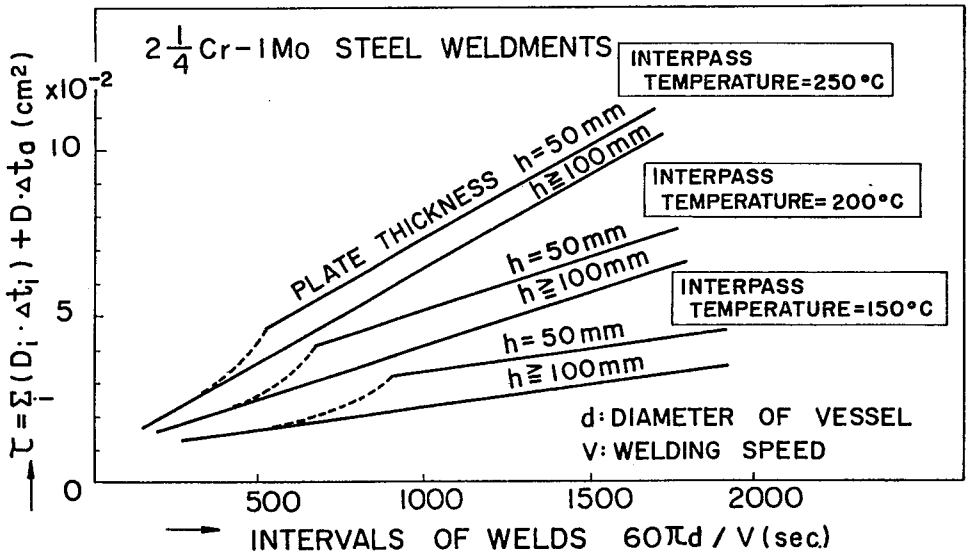

In FIG. 11, the straight line which extends out of the broken line indicates the relation between the time $\Delta ta$ in which the welding of the next pass is initiated after the bead temperature reaching the interpass temperature and the increase in $\tau$ due to the auxiliary heating, namely, the relation of $D \cdot \Delta ta$. Therefore, the gradient of the straight line equals the coefficient of hydrogen diffusivity at the interpass temperature. It is clear therefrom that the pass interval imposes a great influence on the parameter $\tau$ in consideration of the auxiliary heating. FIG. 12 shows their relation in both cases where the interpass temperature is 150° C. and 250° C. Upon comparing this figure with FIG. 11, it is observed that the influence of the auxiliary heating on the parameter $\tau$ becomes greater with a higher interpass temperature although its effect is unexpectable at the temperature of 150° C.

Thus, the hydrogen concentration in weld metal of 2¼Cr—1Mo steel weldments immediately after welding under given conditions can readily be obtained from the diagram of FIG. 9(A) by equivalently substituting thereinto the value of $\tau$ as determined by FIG. 11 or FIG. 12.

Figure 13:
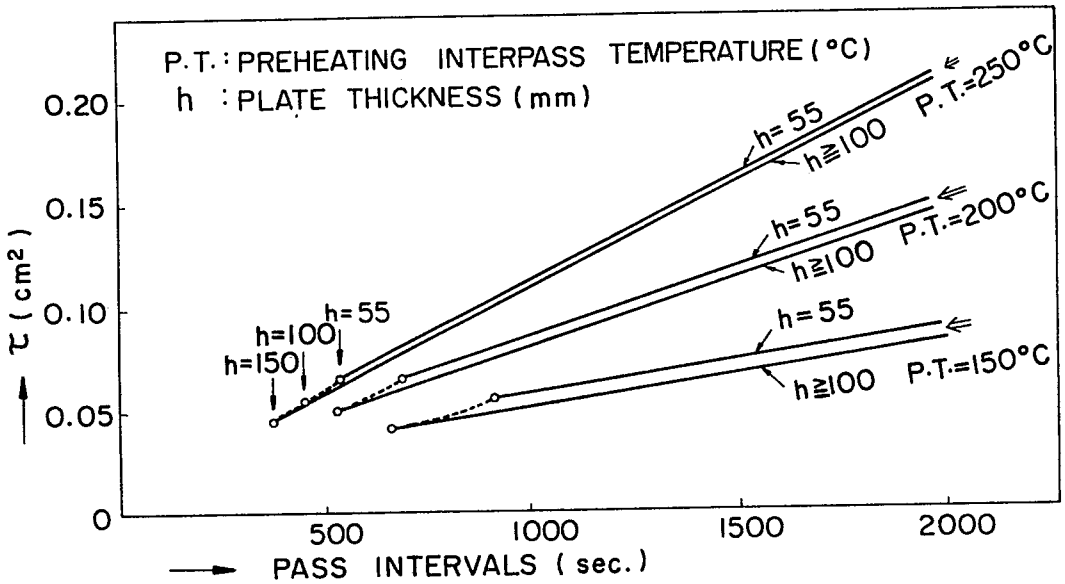
FIG. 13 is a diagram showing the same relation for A508 Class 3 weldments as FIGS. 11 and 12.

As for the hydrogen concentration in HAZ of A508 Class 3 weldments, relationship shown in FIG. 13 was obtained. So, its value immediately after welding can be obtained by combining FIG. 9(B) and FIG. 13.

2. Relation between variations in hydrogen concentration during low temperature PWHT and treating conditions

2-1. Influence of initial hydrogen distribution

Since the transverse weld cracking is most susceptible to occur in the vicinity of the peak of the hydrogen concentration, it is important to clarify the relation between the variations in the peak values of the hydrogen concentration both in weld metal and in HAZ during the low temperature PWHT and the treating conditions in order to prevent transverse cracking. This paragraph deals with the influence of the hydrogen concentration distribution immediately after welding on that relation.

Figure 14A:
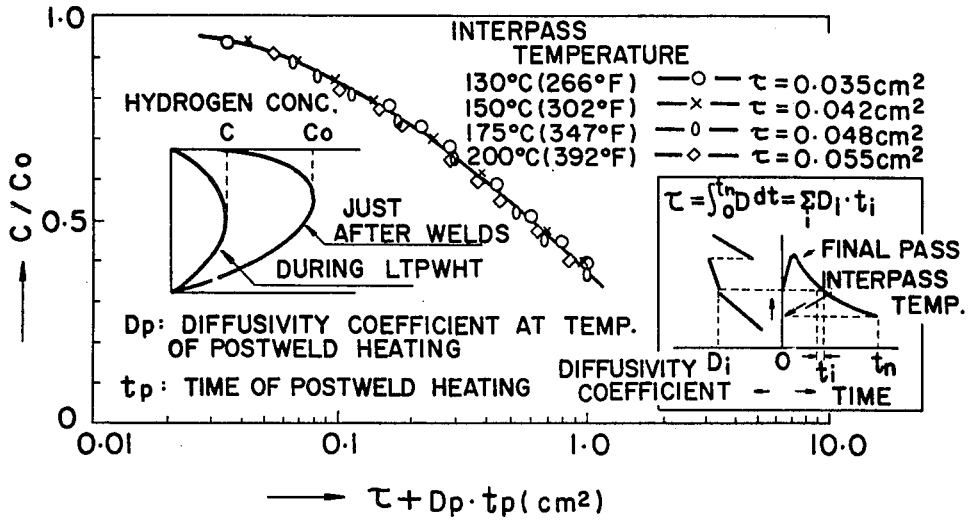
FIG. 14(A) is a diagram showing the influence of the hydrogen concentration distribution immediately after welding on the relation between the variation in hydrogen concentration in weld metal and treating conditions of the low temperature PWHT.

FIG. 14(A) illustrates the relation between the peak value of the hydrogen concentration in weld metal during the low temperature PWHT and the treating conditions. In the diagram of FIG. 14(A), the ordinate represents the ratio of the peak value C of the hydrogen concentration in the low temperature PWHT in weld metal to the hydrogen concentration Co immediately beneath the final bead after welding, while the abscissa represents the sum of the value of the parameter $\tau$ of hydrogen diffusion during welding and the product $D_p \cdot t_p$ of the coefficient of hydrogen diffusivity at the temperature of the PWHT and the holding time. Thus, the diagram of FIG. 14(A) shows, by way of the relation between C/Co and $(\tau+D_p \cdot t_p)$, the influence of the initial hydrogen distribution on the relation between the variation in the peak value of the hydrogen concentration in the low temperature PWHT and the treating conditions, namely, the influence of the hydrogen distribution immediately after the bead temperature reaching the level of the interpass temperature upon completion of welding. The initial hydrogen concentration distribution was varied by changing the preheating and interpass temperatures in various ways. It is observed therefrom that, even if the initial hydrogen distribution is varied, it is possible to express the relation between the variations in the peak value of the hydrogen concentration and the treating conditions substantially by a single curve based on the relation of C/Co and $(\tau+D_p \cdot t_p)$.

Figure 14B:
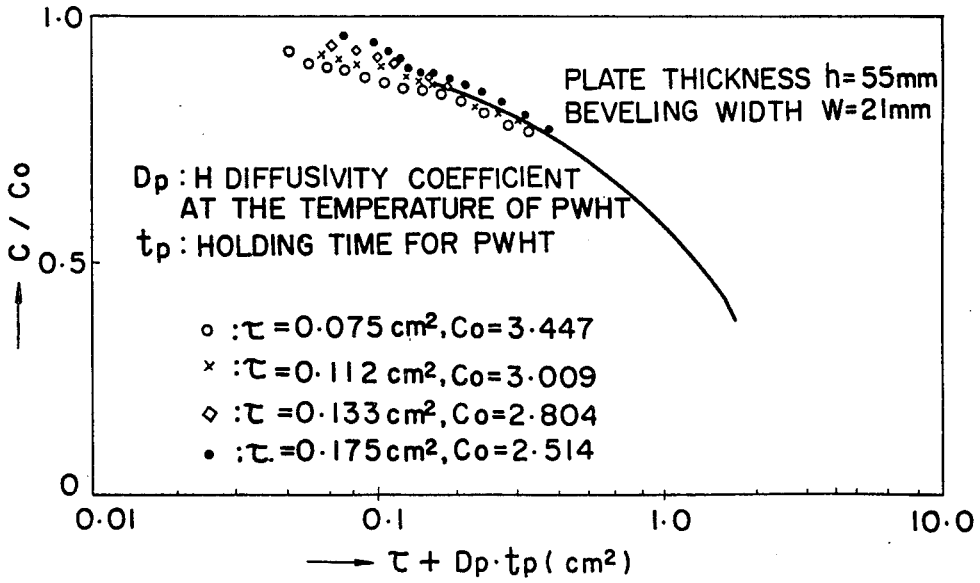
FIG. 14(B) is the same diagram for HAZ as FIG. 14(A)

A similar relation was obtained for HAZ as shown in FIG. 14(B). The change of hydrogen concentration in HAZ through PWHT except for the early stage of it can also be expressed by a single curve regardless of hydrogen concentration distribution immediately after welding.

2-2. Influences of plate thickness

Figure 15A:
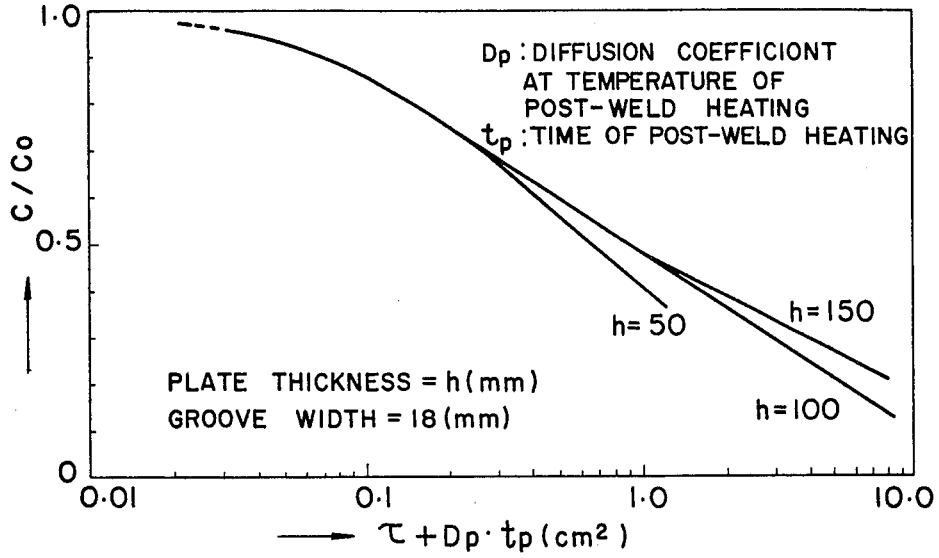
FIG. 15(A) is a diagram for weld metal showing the similar influence of the plate thickness.

The diagram of FIG. 15(A) shows the influence of the plate thickness on the relation between the peak values in weld metals and the treating conditions. As clear therefrom, no influence of the plate thickness is observed in the initial stage of the low temperature PWHT. This is because the peak value of the hydrogen concentration is located immediately beneath the final bead and the hydrogen diffusion at that position is greatly influenced by the plate surface. Further, as the heat treatment proceeds, the influence of the plate thickness is gradually manifested due to inward shift of the peak position of the hydrogen concentration. Judging from the conditions of low temperature PWHT which prevent the cracking, the value of $(\tau+D_p \cdot t_p)$ should be smaller than 1.5 $cm^2$ at largest in the case of $2\frac{1}{4}$Cr—1Mo steel weldments by submerged arc welding process with the heat input of 40 KJ/cm. Therefore, with a plate thickness in excess of 100 mm, the preventing condition for a cold cracking induced in weld metal of $2\frac{1}{4}$Cr—1Mo steel weldments can be obtained from the relation between C/Co and $(\tau+D_p \cdot t_p)$ for the plate thickness of 100 mm.

Figure 15B:
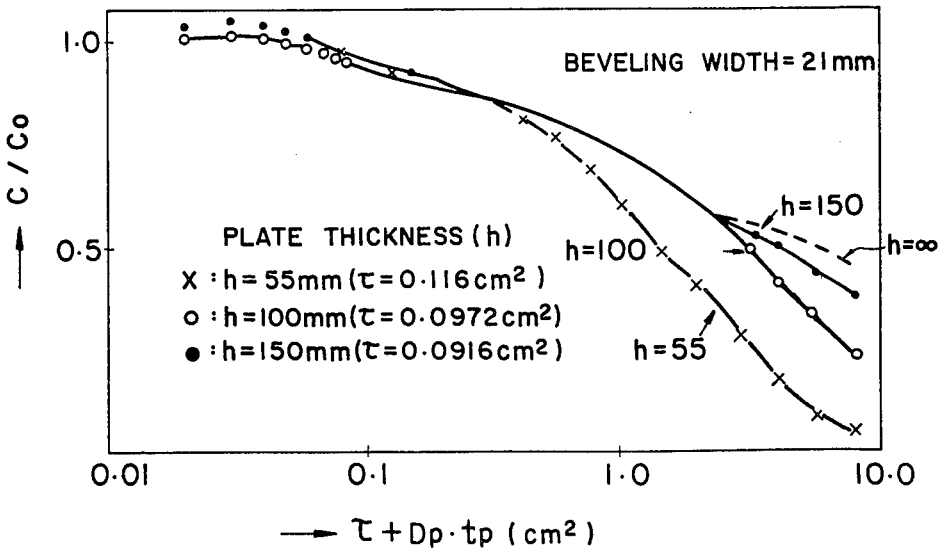
FIG. 15(B) is the similar diagram for HAZ as FIG. 15(A)

A similar relation for HAZ was obtained as indicated in FIG. 15(B).

2-3. Influence of beveling width

Figure 16A:
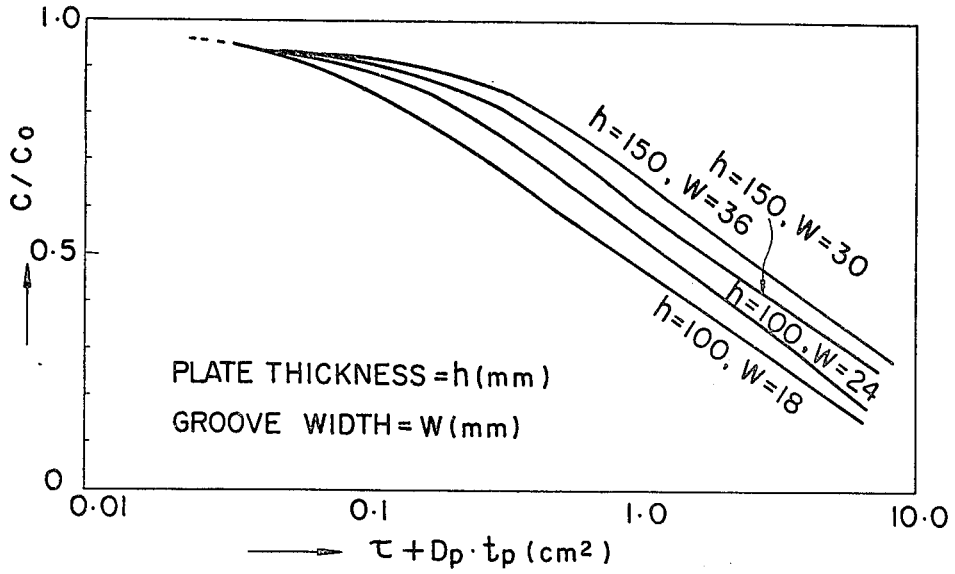
FIG. 16(A) is a diagram for weld metal showing the similar influence of the beveling width.
Figure 16B:
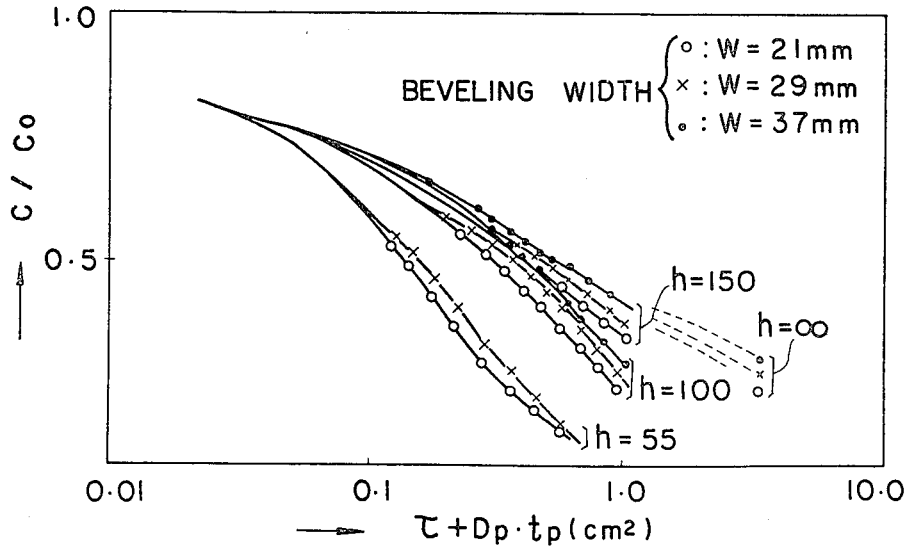
FIG. 16(B) is the similar diagram for HAZ as FIG. 16(B)

FIG. 16(A) shows the influence of the beveling width of the weld on the relation between C/Co in weld metal and $(\tau+D_p \cdot t_p)$. FIG. 16(B) is for HAZ. It is clear therefrom that the change of the hydrogen concentration is delayed with a larger beveling width since the gradient of hydrogen concentration in a direction perpendicular to the weld line becomes smaller as the beveling width is increased. When considering the hydrogen diffusion in the weld, it is often discussed as a one-dimensional diffusion in the direction of plate thickness, ignoring the diffusion from the weld to the base metal. However, in view of FIGS. 15(A), (B) and 16(A), (B) which show the influence of the beveling width rather than that of the plate thickness, such a discussion is obviously meaningless. Although FIG. 16(A) shows the influence of the beveling width of up to 36 mm, it is the general practice in the welding in flat position to design the beveling at a constant width taking into account the transverse contraction of the weld, for ensuring high welding efficiency. Therefore, the beveling width for plates of a thickness of about 300 mm may be taken as about 36 mm at maximum. On the other hand, in horizontal position, the beveling width is increased with a greater plate thickness and may exceed 36 mm in some cases. Therefore, next considered is the relation between C/Co in weld metal and $(\tau+D_p \cdot t_p)$ in a case where the beveling width is greater than 36 mm.

With a heavier plate thickness, the diffusion takes place to a greater degree in the direction of plate width than in the injection of plate thickness. Now, assuming that the diffusion occurs only in the direction of plate width according to Fick's Second Law, the ratio of the hydrogen concentration C at the center of the weld during the low temperature PWHT to the initial hydrogen concentration Co can be expressed simply as $C/Co=\Phi(W/4\sqrt{\tau+D_p \cdot t_p})$, in which $\Phi$ is an error function. The influence of a beveling width greater than 36 mm can thus be approximately expressed by arranging the results of the case of h=150 mm and W=36 mm of FIG. 16(A) in the relation between C/Co and $4\sqrt{\tau+D_p \cdot t_p}/W$.

Figure 17:
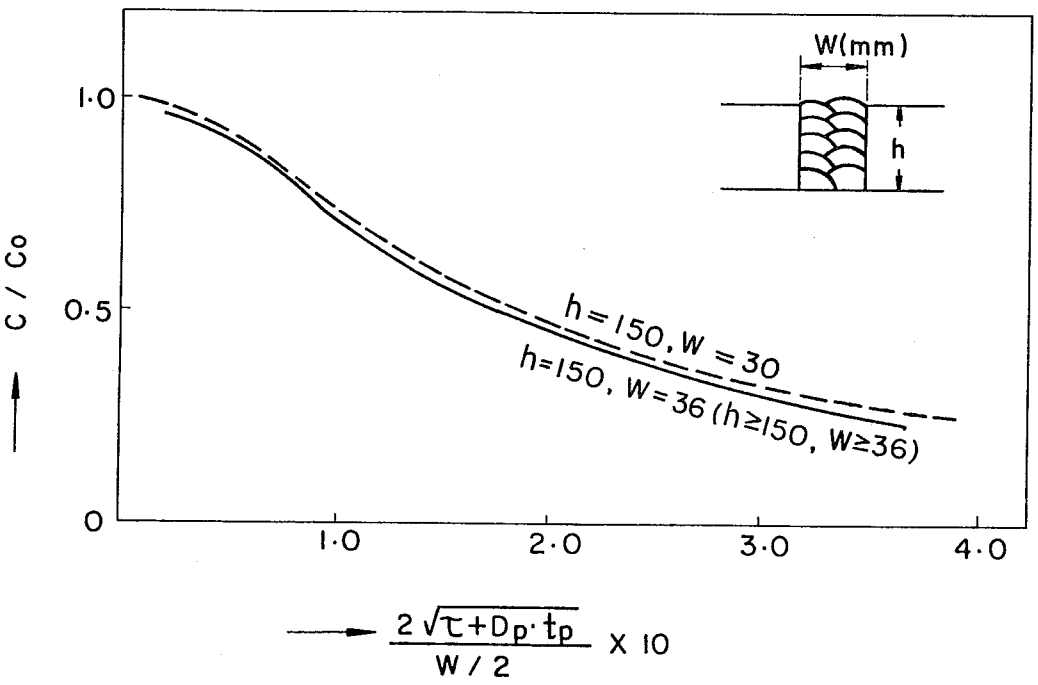
FIG. 17 is a diagram showing the relation between the variations in the hydrogen concentration and PWHT conditions in a case where the beveling width exceeds 36 mm.

The solid line in FIG. 17 is a plot of the thus obtained relation between the variation in the hydrogen concentration in the low temperature PWHT, treating conditions and beveling width. However, this relation fails to sufficiently take into account the diffusion in the direction of plate thickness except for the case where W=36 mm, underestimating the diffusion in an increasing degree as the beveling width becomes larger than 36 mm. As a result, C/Co is given a value which is greater than its actual value. However, as mentioned hereinbefore, the diffusion in the direction of plate thickness is considered to take place to a small degree as compared with that in the direction of plate width in a case where the plate thickness is sufficiently large relative to the beveling width, approximately establishing the relation shown. Therefore, the relation of C/Co and $(\tau+D_p \cdot t_p)$ in the case where h=150 mm and W=30 mm of FIG. 16 was arranged into the relation of C/Co and $4\sqrt{\tau+D_p \cdot t_p}/W$ as indicated by a curve of broken line in FIG. 17. Upon comparing the curves of solid and broken lines, it will be clear that the relation between C/Co and $4\sqrt{\tau+D_p \cdot t_p}/W$ undergoes almost no changes in spite of variations in W. Thus, it is possible to obtain safe and approximately correct conditions for the low temperature PWHT for weld metal by applying the curve of solid line to beveling widths greater than 36 mm.

The same relation with regard to the change of hydrogen concentration in HAZ where the beveling width is greater than 37 mm, can easily be obtained by making use of the relation in case of plate thickness and beveling width being 150 mm and 37 mm, which is shown in FIG. 16(B).

Figure 18A:
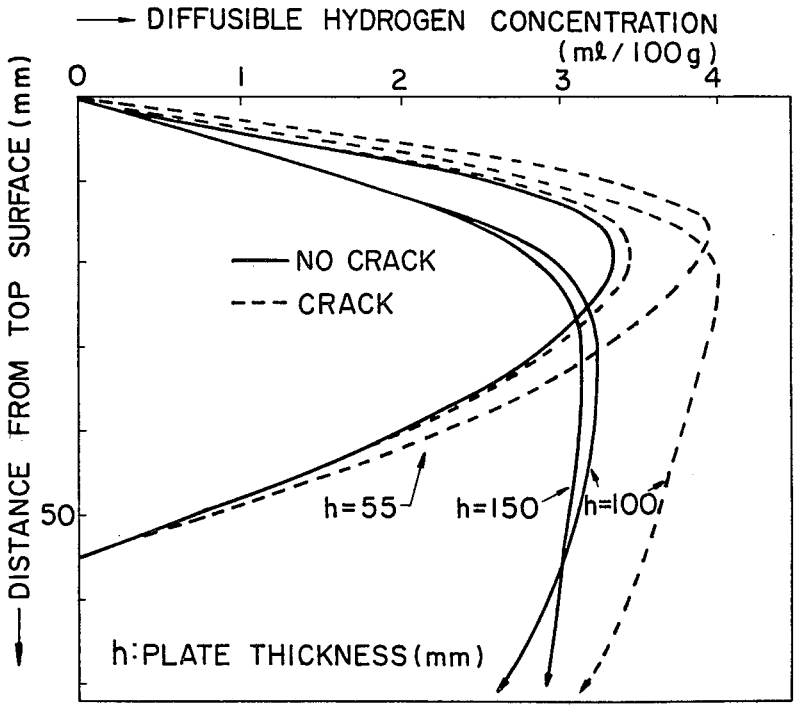
FIGS. 18(A) and 18(B) are the diagrams showing the results of cracking tests for 2¼Cr—1Mo steel and A508 Class 3 material along with the distribution of hydrogen concentration, which were conducted for determining the crack-preventing critical hydrogen concentration.

3. Critical hydrogen concentration for preventing transverse cracking in weld zone in butt welding FIG. 18(A) shows the results of cracking tests under different conditions of welding and low temperature PWHT along with hydrogen distributions in the respective test conditions. Since prevention of the cold cracking is considered to depend on the cooling rate to the level of 100° C., the critical hydrogen concentration for the prevention of cracking is expressed by values at the time when the test pieces are cooled to 100° C. The curves in this figure indicate the hydrogen concentration distributions in the cooled test pieces at 100° C., of which curves of broken lines are of test pieces with a crack and the curves of solid lines are of test pieces without a crack. It will be clear therefrom that the crack-preventing critical hydrogen concentration in the weld in butt welding of 2¼Cr—1Mo steel is about 3.3 cc/100 gr at a peak value.

Figure 18:
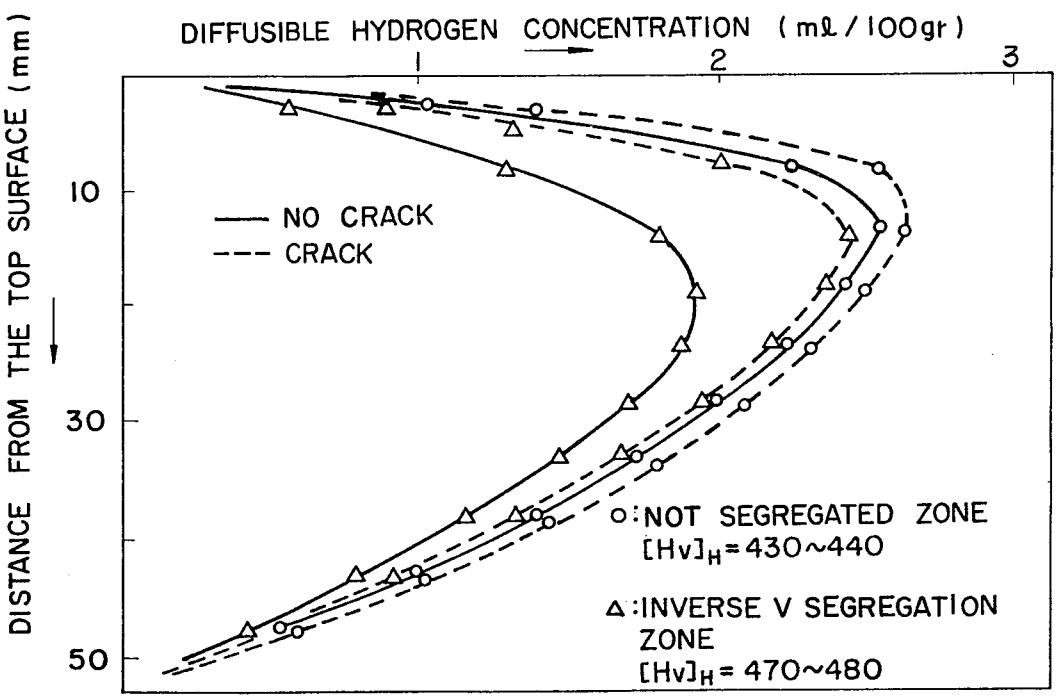

On the other hand, as for A508 C1.3 weldments, its susceptibility to transverse weld cracking induced in HAZ depends upon the extent of the segregation of alloying elements and impure elements, such as C, Mn, Si, Mo, S, and so forth. In other words, the critical hydrogen concentration changes depending upon whether HAZ contains a so-called inverse V segregation zone, or not, as shown in FIG. 18 (B). This is because such a segregation hardens the microstructure of HAZ to a high degree.

Figure 19:
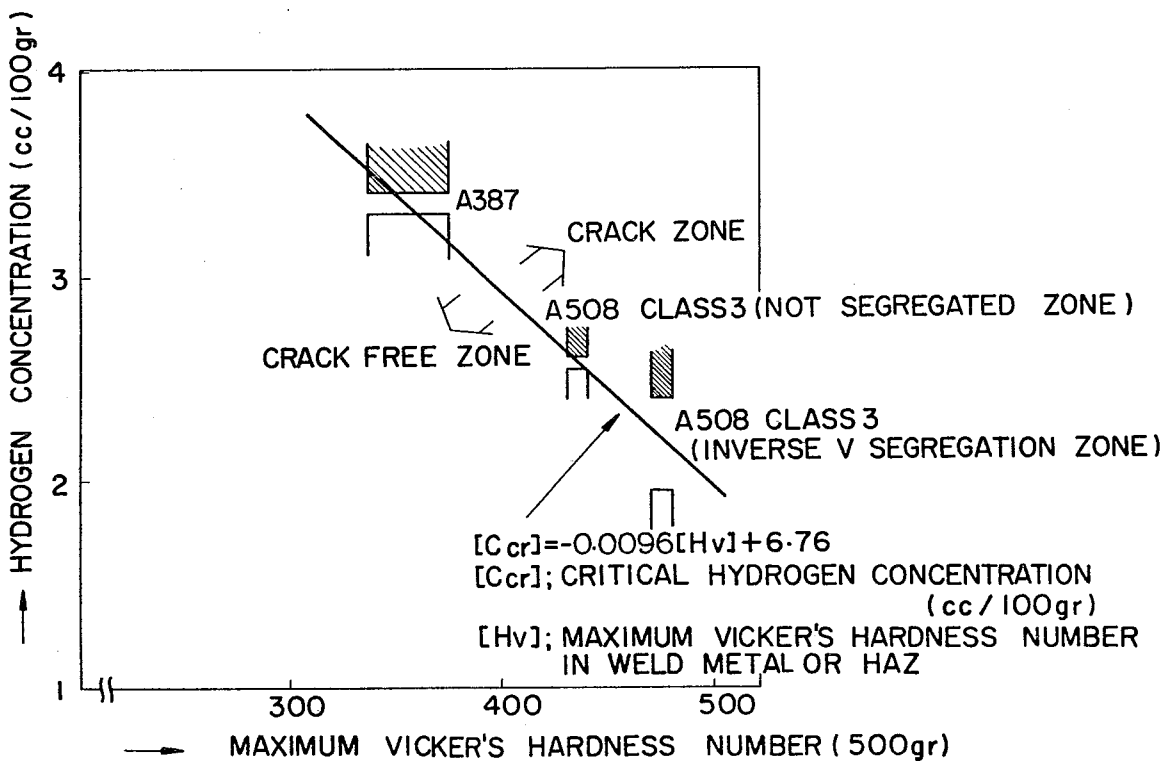
FIG. 19 is a graph showing the relation between the crack-preventing critical hydrogen concentration in weld metal or in HAZ and maximum Vicker's hardness number of microstructure in the respective region.

From these data, a relation practically useful to determine the critical hydrogen concentration can be introduced under which any transverse weld cracking will not occur either in weld metal or in HAZ. FIG. 19 shows the relation between the hydroen concentration and the microstructure in weld zone in terms of maximum Vicker's hardness number with regard to the occurrence of the crack. Therefore, a straight line in the figure shows the relation between the critical hydrogen concentration [CCr] and the maximum Vicker's hardness number in weld zone [Hv], as is represented by an equation:

$$[Ccr] = -0.0096[Hv] + 6.76 \quad (1)$$

where [Hv] is in the range of 300 to 500. Using this relationship, the critical hydrogen concentration can easily be determined depending upon base metal and welding conditions, such as welding materials, weld heat input, and so forth, through the maximum Vicker's hardness number in weld zone produced under the respective conditions.

As a result, using the value of [Ccr] obtained from the above equation, the minimum condition of low-temperature PWHT required to prevent the transverse crack induced in multi-layer welds can be determined. Of course, in order to determine the practical condition of PWHT, the value of [Ccr] should be estimated lower to a certain extent than the value obtained from the equation because the factor of safety should be modified depending upon the importance of the structure, accuracy of non-destructive inspection employed for weld zone, and so forth.

4. Condition for preventing cracking through low temperature PWHT

As mentioned hereinabove, the conditions for preventing cracking through low temperature PWHT depend on factors such as the shape and dimensions of the weld, the hydrogen level of the flux, type of the base metal or its combination with welding materials and the conditions of the welding operation. As an example the conditions for a particular operation for 2¼Cr—1Mo steel weldments are determined by the following procedures.

(1) For given plate thickness at the weld, preheating and interpass temperatures, number of weld passes per layer, and pass intervals, the parameter which governs the hydrogen diffusion at the time of welding is decided by the use of the diagram of FIG. 11 or FIG. 12.

(2) In FIG. 9(*a*) the value of the hydrogen concentration Co is found which is determined by the parameter. Here, Co,o represents the mean hydrogen concentration in the weld immediately after welding the first pass and is 4.74 cc/100 g in the case of submerged arc welding using the flux MF-29 A.

(3) The values of the crack-preventing critical hydrogen concentration Ccr are obtained from the relation between Ccr and maximum Vicker's hardness number in weld metal, mentioned in the preceding paragraph and its ratio Ccr/Co to the hydrogen concentration Co immediately after welding.

The values of Ccr/Co of the preceding step (3) are plotted on the ordinate of the diagram of FIG. 16(A) or FIG. 17, reading out the necessary treating conditions ($\tau + D_p \cdot t_p$) on the abscissa according to the given plate thickness and beveling width.

Figure 20:
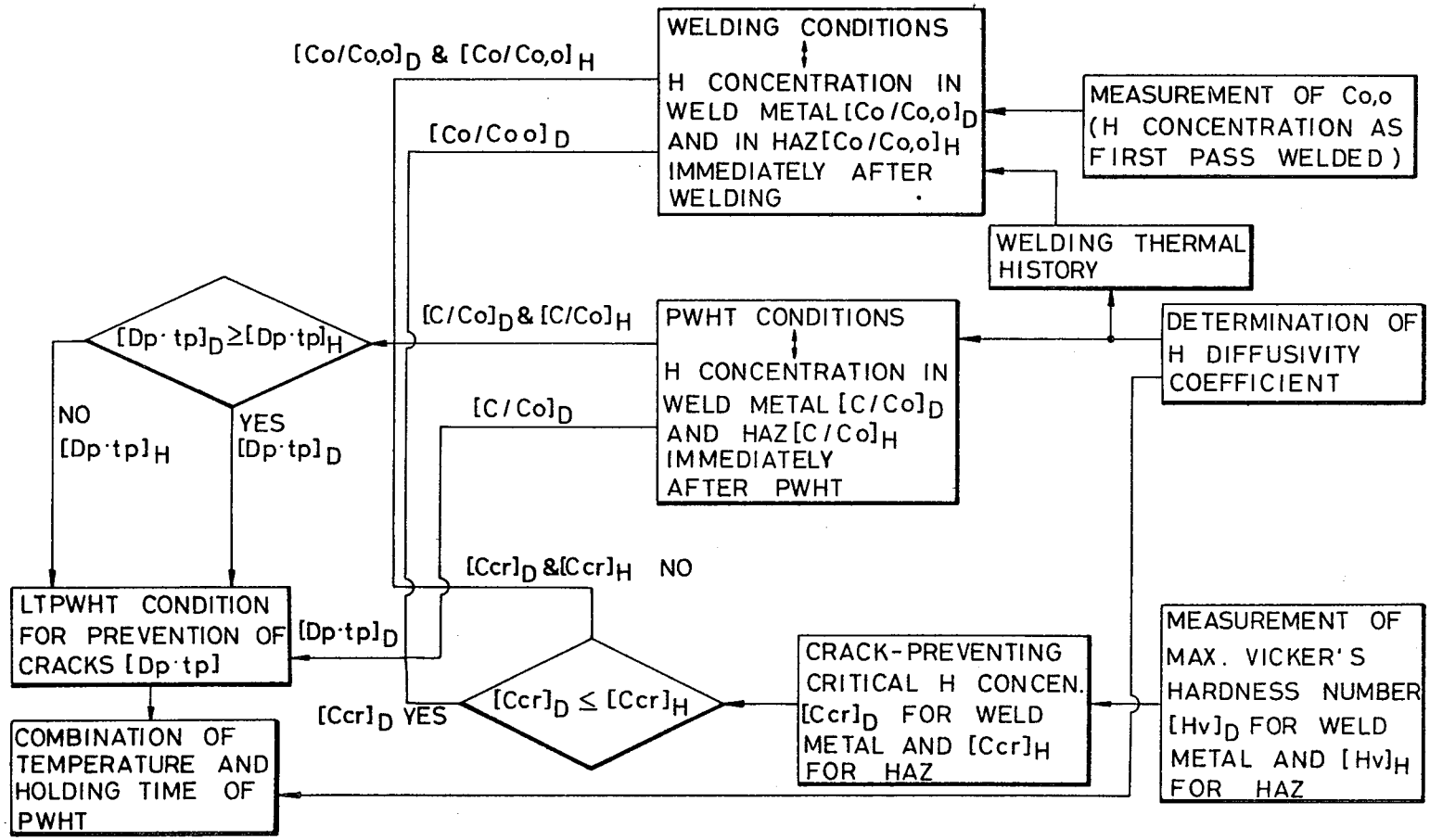
FIG. 20 is a flow chart illustrating procedures for determining the conditions of the crack-preventing low temperature PWHT for various materials.

(5) The value of $\tau$ of the step (1) is subtracted from the value of ($\tau + D_p \cdot t_p$) of the step (4) to obtain the low temperature PWHT conditions $D_p \cdot t_p$ suitable for the plate thickness, preheating and interpass temperatures, number of weld passes per layer, pass intervals, maximum Vicker's hardness number in weld zone, and beveling width as specified in the steps (1) through (4). Here, the values of $D_p$ and $t_p$ represent the hydrogen diffusivity coefficient and the holding time at the treating temperature, respectively, so that the holding time for a given treating temperature can be obtained according to the relation between the hydrogen diffusivity coefficient and the temperature. The same condition of PWHT required to prevent the occurrence of a cold cracking in other low alloy steel weldments can be evaluated by following the procedure presented in FIG. 20.

Figure 21:
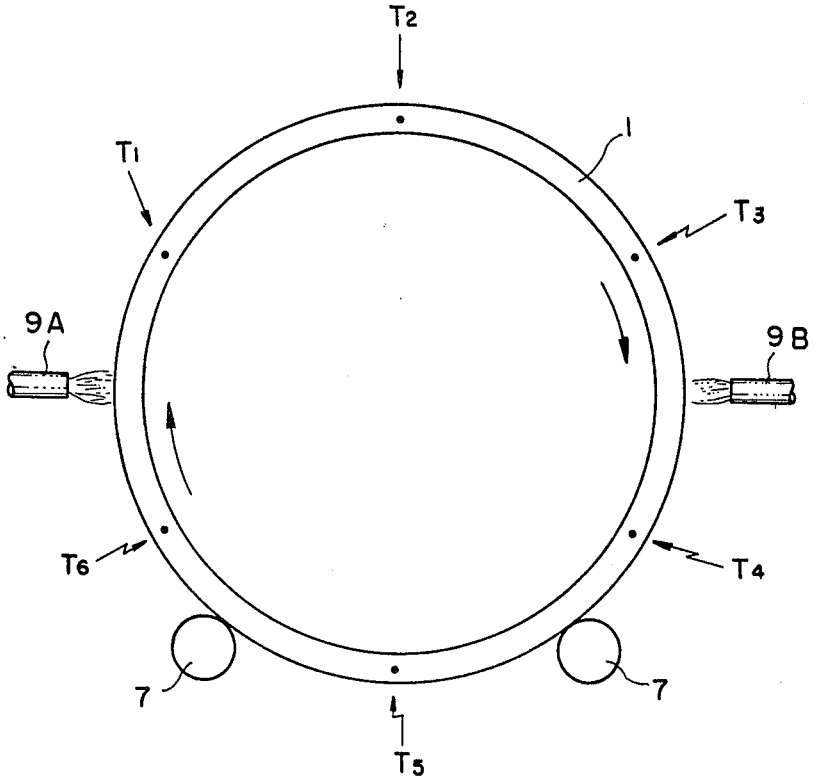
FIG. 21 is a diagram showing the variations in the coefficient of hydrogen diffusion versus time.

FIG. 21 schematically shows the PWHT in multilayer welding of a circumferential joint of a pressure vessel, wherein a shell course of a vessel 1 which is rotated on turning rollers 7 in the arrowed direction is heated at two positions by burners 9A and 9B while measuring the temperature of the shell course 1 at six different positions $T_1$ to $T_6$. There are no restrictions on the numbers of the burners and measuring points or on the measuring positions or method. However, it is preferred to provide the burners and measuring points at as many positions as possible in order to enhance the accuracy of the heat control. The dissipation of diffusible hydrogen is improved all the more in a case where the shell course is heated on both the inner and outer sides thereof.

Figure 22:
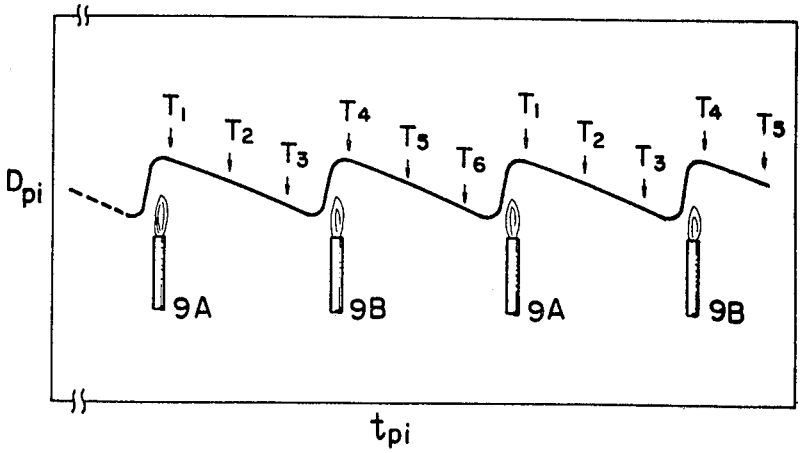
FIG. 22 is a diagram showing the relation between the lapse of time in the course of measurement at the respective measuring points of the temperatures of the shell course 1 heated by burners 9A and 9B and the hydrogen diffusivity coefficient ($D_{pi}$) at the respective temperatures.

The diagram of FIG. 22 shows the relation between the lapse of time in the course of measurement at the respective measuring points of the temperatures of the shell course 1 heated by burners 9A and 9B and the hydrogen diffusivity coefficient ($D_{pi}$) at the respective temperatures. In order to assist understanding of the present invention, the diagram shows the positions of the burners 9A and 9B relative to the measuring points. It will be seen therefrom that the hydrogen diffusivity coefficient ($D_{pi}$) has a pattern of declining from $T_1$ to $T_3$ and from $T_4$ to $T_6$.

While rotating the vessel for the LTPWHT in the above-described manner, the value of $D_{pi}$ which varies with lapses of time is time-integrated until its cumulative value reaches $D_p \cdot t_p$ determined in the step (5). Upon detection of the time point when the time integration of $D_{pi}$ reaches $D_p \cdot t_p$, the LTPWHT is terminated since the concentration of diffusible hydrogen at the peak position is smaller than the critical hydrogen concentration Ccr at that time point.

In a welding operation other than the circumferential welding of a vessel, for instance, in an operation for a seam welding or for welding a nozzle to a pressure vessel, the weld line is uniformly heated along the entire length thereof so that the temperatures measured only at one arbitrary point may be used for the control of the PWHT.

It will be appreciated from the foregoing description that, according to the method of the present invention, it becomes possible to judge the terminating point of the LTPWHT correctly and to improve the quality control by precluding the cracking due to insufficient LTPWHT or uneconomical excessive PWHT, so called intermediate stress relief annealing.

Obviously, numerous additional modifications and variations of the present invention are possible in light of the above teachings. It is therefore to be understood that within the scope of the appended claims, the invention may be practiced otherwise than as specifically described herein.

What is claimed is:

1. A method for low-temperature PWHT in multilayer welding, of low alloy steel which comprises;

determining a residual hydrogen concentration Co (cc/100 g) directly beneath the final welded layer immediately after completion of welding;

determining a crack-preventing critical hydrogen concentration Ccr (cc/100 g) to obtain a ratio of Ccr/Co;

determining the value of a product $D_p \cdot t_p$ of a hydrogen diffusivity coefficient $D_p$ ($cm^2$/sec.) during the heat treatment and a holding time $t_p$ (sec.) where a currently reached hydrogen concentration C (cc/100 g) becomes equal to the critical hydrogen concentration Ccr, on the basis of the relation of a ratio C/Co of the current hydrogen concentration C (cc/100 g) to the residual hydrogen concentration Co and a sum of a parameter $\tau$($cm^2$) of hydrogen diffusion of the formula given below and the product of $D_p \cdot t_p$;

measuring the temperature of the heat treatment at a suitable position of the weld; and terminating the heat treatment at a time point when a time-integrated value of a hydrogen diffusivity coefficient $D_{pi}$ ($cm^2$/sec.) at the measured temperature exceeds the value of $D_p \cdot t_p$ under given conditions $$\tau = \int_0^{tn} D_i dt$$

wherein,

PWHT: postweld heat treatment, $D_i$: a hydrogen diffusivity coefficient ($cm^2$/sec.) in an arbitrary weld portion during welding each unit layer; and tn: time (sec.) required for welding each unit layer and wherein the critical hydrogen concentration $C_{cr}$, is related to the Vicker's hardness number, $H_v$, such that $C_{cr}$ ranges from 1.96 to 3.88 cc/100 g while H correspondingly ranges from 300 to 500.

2. A method for the low-temperature PWHT as set forth in claim 1, comprising determining the parameter $\tau$ of hydrogen diffusion and the dissolved hydrogen concentration Co,o (cc/100 g) under given welding conditions, and determining Co on the basis of the relation between the parameter $\tau$ and Co/Co,o.

3. A method for the low-temperature PWHT as set forth in claim 1 or 2, comprising heating a circumferential weld of a rotated heavily thick vessel by more than one burner, measuring the temperature of said weld at an arbitrary point thereof to obtain variations in a hydrogen diffusivity coefficient $D_{pi}$ against time, and detecting the time point when the time-integrated value of said coefficient $D_{pi}$ exceeds the value of $D_p \cdot t_p$.

4. A method for the low-temperature PWHT as set forth in claim 1 or 2, comprising heating a butt weld line from one side thereof by a plurality of fixed burners while measuring temperatures at arbitrary differing points on the other side of said weld line to obtain variation in the hydrogen diffusivity coefficient $D_{pi}$ against time, and detecting a point in time when the time-integrated value of $D_{pi}$ exceeds the value of $D_p \cdot t_p$.

5. A method for the low-temperature postweld heat treatment in multilayer welding of low alloy steel, which comprises obtaining a residual hydrogen concentration $Co_D$ and $Co_H$(cc/100 g) directly beneath the finally welded layer immediately after completion of multilayer welding, where $Co_D$ and $Co_H$ are for weld metal (deposited metal) and for heat affected zone, respectively;

obtaining a critical hydrogen concentration for prevention of cracking $Ccr_D$ and $CCr_H$ for the weld metal and for the heat affected zone, respectively, which depend upon the maximum residual stress and maximum Vicker's hardness number of microstructure in the weld zone wherein the critical hydrogen concentration, $C_{cr}$, is related to the Vicker's hardness number, $H_v$, such that $C_{cr}$ ranges from 1.96 to 3.88 cc/100 g while $H_v$ corresponding ranges from 300 to 500;

obtaining the values of $Ccr/Co_D$ and $CCr/Co_H$, ratio of the critical hydrogen concentration $Ccr_D$ and $Ccr_H$ for prevention of cracking both in the weld metal and the heat affected zone to the residual hydrogen concentration $Co_D$ and $Co_H$;

obtaining the values of $C/Co_D$ and $C/Co_H$ for the weld metal and for the heat affected zone, the ratio of the hydrogen concentration in the weld zone $C_D$ and $C_H$ which are lessened by the low-temperature postweld heat treatment to the residual hydrogen concentration $Co_D$ and $Co_H$;

obtaining the values of $(\tau + D_p \cdot t_p)_D$ and $(\tau + D_p \cdot t_p)_H$ for the weld metal and for the heat affected zone where $D_p$ is hydrogen diffusivity coefficient during the postweld heat treatment and $t_p$ is the holding time, and $\tau$($cm^2$) is a hydrogen diffusion parameter in a welding operation under given conditions $$\tau = \int_0^{tn} D_i dt$$

wherein $D_i$ is a hydrogen diffusivity coefficient ($cm^2$/sec.) in an arbitrary weld zone of each unit and tn is the time required for welding each unit layer;

determining a larger value $D_p \cdot t_p$ of $D_p \cdot t_{pD}$ or $D_p \cdot t_{pH}$ by comparing these values, as a condition of the postweld heat treatment;

measuring the temperature at a suitable portion of the weld during the postweld heat treatment, and terminating the heat treatment at a point in time when the time-integrated value of the hydrogen diffusivity coefficient $D_{pi}$ ($cm^2$/sec.) at the measured temperature exceeds the value of $D_p \cdot t_p$.

6. The method as set forth in claim 5, wherein the critical hydrogen concentration $Ccr_D$ and $Ccr_H$ are obtained by the following equations $$Ccr_D = -0.0096Hv_D + 6.76$$

and $$CCr_H = -0.0096Hv_H + 6.76$$

where $Hv_D$ and $Hv_H$ are maximum Vicker's hardness number in the weld metal and in the heat affected zone.

7. A method for low-temperature PWHT in multilayer welding, of low alloy steel which comprises:

determining a residual hydrogen concentrations (cc/100 g) directly beneath the final welded layer immediately after completion of welding;

determining a crack-preventing critical hydrogen concentration CCr (cc/100 g) to obtain a ratio of Cor/Co;

determining the value of a product $D_p\,t_p$ of a hydrogen diffusivity coefficient $D_p$ ($cm^2$/sec. during the heat treatment and a holding time $t_p$ (sec.) where a currently reached hydrogen concentration C (Co/100 g) becomes equal to the critical hydrogen concentration CCr, on the basis of the relation of a ratio C/Co of the current hydrogen concentration C (cc/100 g) to the residual hydrogen concentration Co and a sum of a parameter t($cm^2$) of hydrogen diffusion of the formula given below and the product of $D_p \cdot t_p$;

measuring the temperature of the heat treatment at a suitable position of the weld; and terminating the heat treatment at a time point when a time-integrated value of a hydrogen diffusivity coefficient $D_{pi}$ ($cm^2$/sec.) at the measured temperature exceeds the value of $D_p \cdot t_p$ under given conditions $$t = \int_0^{tn} D_i dt$$

wherein,

PWHT: postweld heat treatment, $D_i$: a hydrogen diffusivity coefficient ($cm^2$/sec.) in an arbitrary weld portion during welding each unit layer; and tn: time (sec.) required for welding each unit layer and wherein the critical hydrogen concentration Ccr has the following relation with maximum Vicker's hardness number in the weld zone Hv; Ccr=0.0096 Hv+6.76 where Hv is in the range of 300 to 500.

* * * * *